US011203921B2

(12) United States Patent
Gardes

(10) Patent No.: US 11,203,921 B2
(45) **Date of Patent: *Dec. 21, 2021**

(54) CONTINUOUS CIRCULATING CONCENTRIC CASING MANAGED EQUIVALENT CIRCULATING DENSITY (ECD) DRILLING FOR METHANE GAS RECOVERY FROM COAL SEAMS

(71) Applicant: Robert Gardes, Lafayette, LA (US)

(72) Inventor: Robert Gardes, Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/687,163

(22) Filed: Nov. 18, 2019

(65) Prior Publication Data

US 2020/0325756 A1 Oct. 15, 2020

Related U.S. Application Data

(63) Continuation of application No. 15/676,420, filed on Aug. 14, 2017, now Pat. No. 10,480,292, which is a (Continued)

(51) Int. Cl.
*E21B 43/00* (2006.01)
*E21B 7/04* (2006.01)
(Continued)

(52) U.S. Cl.
CPC ..... *E21B 43/006* (2013.01); *E21B 7/046* (2013.01); *E21B 21/08* (2013.01);
(Continued)

(58) Field of Classification Search
CPC ... E21B 43/006; E21B 43/305; E21B 41/0057
See application file for complete search history.

(56) References Cited

U.S. PATENT DOCUMENTS 4,679,630 A 7/1987 Wyman
5,215,151 A 6/1993 Smith et al.
(Continued)

OTHER PUBLICATIONS

Schlumberger Oilfield Glossary entry for underbalance (URL:http://www.glossary.oilfield.slb.com/Terms/u/underbalance.aspx) (accessed by USPTO Oct. 14, 2016).
(Continued)

*Primary Examiner* — Blake E Michener
(74) *Attorney, Agent, or Firm* — Garvey, Smith & Nehrbass, Patent Attorneys, L.L.C.; Julia M. FitzPatrick; Gregory C. Smith

(57) ABSTRACT

A method of drilling multiple boreholes within a single caisson, for recovery of methane gas from a coal bed, including the steps of drilling first and second vertical boreholes from a single location within a single caisson; drilling at least one or more horizontal wells from the several vertical bore hole, the horizontal wells drilled substantially parallel to a face cleat in the coal bed; drilling at least one or more lateral wells from the one or more horizontal wells, the lateral wells drilled substantially perpendicular to one or more face cleats in the coal bed; continuously circulating water through the drilled vertical, horizontal and lateral wells to recover the water and entrained methane gas from the coal bed; applying friction or choke manifold to the water circulating down the well bores so that the water appears to have a hydrostatic pressure within the well sufficient to maintain an equilibrium with the hydrostatic pressure in the coal bed formation; and drilling at least a third vertical borehole within the single caisson, with one or more horizontal boreholes and one or more lateral boreholes for returning water obtained from the lateral wells into a water zone beneath the surface.

14 Claims, 12 Drawing Sheets

Related U.S. Application Data continuation of application No. 14/282,526, filed on May 20, 2014, now Pat. No. 9,732,594.

(60) Provisional application No. 61/825,325, filed on May 20, 2013.

(51) Int. Cl.

| | |
|---|---|
| ***E21B 41/00*** | (2006.01) |
| ***E21B 43/30*** | (2006.01) |
| ***E21B 21/08*** | (2006.01) |
| ***E21B 43/38*** | (2006.01) |

(52) U.S. Cl.

CPC ..... *E21B 41/0057* (2013.01); *E21B 43/305* (2013.01); *E21B 43/385* (2013.01)

(56) References Cited

U.S. PATENT DOCUMENTS

| | | | |
|---|---|---|---|
| 5,394,950 | A | 3/1995 | Gardes |
| 5,411,104 | A | 5/1995 | Stanley |
| 6,923,275 | B2 | 8/2005 | Gardes |
| 7,163,063 | B2 | 1/2007 | Seams |
| 9,732,594 | B2 | 8/2017 | Gardes |
| 10,480,292 | B2 | 11/2019 | Gardes |
| 2002/0007968 | A1 | 1/2002 | Gardes |
| 2002/0096336 | A1 | 7/2002 | Zupanick et al. |
| 2003/0062198 | A1 | 4/2003 | Gardes |
| 2003/0221836 | A1 | 12/2003 | Gardes |
| 2004/0007389 | A1 | 1/2004 | Zupanick |
| 2004/0035582 | A1 | 2/2004 | Zupanick |
| 2004/0050554 | A1 | 3/2004 | Zupanick et al. |
| 2004/0140129 | A1 | 7/2004 | Gardes |
| 2005/0109505 | A1 | 5/2005 | Seams |
| 2005/0252689 | A1 | 11/2005 | Gardes |
| 2006/0213654 | A1 | 9/2006 | Scallen et al. |
| 2008/0060807 | A1 | 3/2008 | Zupanick |
| 2008/0066919 | A1 | 3/2008 | Conrad |
| 2009/0308598 | A1 | 12/2009 | Gardes |
| 2010/0126729 | A1 | 5/2010 | Tunget |
| 2012/0037372 | A1 | 2/2012 | Foundas et al. |

OTHER PUBLICATIONS

Schlumberger Oilfield Glossary entry for circulate (URL:http://www.glossary.oilfield.slb.com/Terms/c/circulate.aspx) (accessed by USPTO Oct. 14, 2016).

Schlumberger Oilfield Glossary entry for overbalance (URL:http://www.glossary.oilfield.slb.com/Terms/o/overbalance.aspx) (accessed by USPTO Oct. 14, 2016).

CONTINUOUS CIRCULATING CONCENTRIC CASING MANAGED EQUIVALENT CIRCULATING DENSITY (ECD) DRILLING FOR METHANE GAS RECOVERY FROM COAL SEAMS

CROSS-REFERENCE TO RELATED APPLICATIONS

This application is a continuation of U.S. patent application Ser. No. 15/676,420, filed on 14 Aug. 2017 (issued as U.S. Pat. No. 10,480,292 on 19 Nov. 2019), which is a continuation of U.S. patent application Ser. No. 14/282,526, filed on 20 May 2014 (issued as U.S. Pat. No. 9,732,594 on 15 Aug. 2017), which claims the benefit of and/or priority to U.S. Provisional Patent Application Ser. No. 61/825,325, filed on 20 May 2013.

Priority of U.S. patent application Ser. No. 15/676,420, filed on 14 Aug. 2017; U.S. patent application Ser. No. 14/282,526, filed on 20 May 2014 and U.S. Provisional Patent Application Ser. No. 61/825,325 filed on 20 May 2013, which is hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The system of the present invention relates to over-pressured coal seams and coal bed methane drilling and completion. More particularly, the present invention relates to a continuous circulating concentric casing system for controlled bottom hole pressure for coal bed methane drilling without the use of weighted drilling fluids containing chemicals utilizing annular friction control and or in conjunction with surface choking to provide the required hydrostatic pressure within the bore hole.

2. General Background

In over-pressured coal (CBM) seams and in circumstances when drilling in the direction perpendicular to the face cleats in the coal seams, which has the highest permeability, but in the lowest borehole stability direction, coal seam permeability is easily damaged by the addition of any chemicals or weighting agents as it becomes necessary to have a fluid in the hole with a higher specific gravity heavier than water. In the prior art, to obtain a specific gravity heavier than water, weighting agents and chemicals have been added to water to obtain a desired hydrostatic weight. What happens in coal is that coal has a unique ability to absorb, and to adsorb a wide variety of chemicals that irreversibly reduce the permeability by as much as 85%.

An objective of the present invention is to eliminate a need to add weighting agents and chemicals. The method of the present invention creates back pressure thru the use of either friction on the return annulus or to choke the return annulus, creating back pressure on the formation, or to use a combination of both to create, thru continuous circulating, an induced higher Equivalent Circulating Density (ECD) on the formation. Thus the formation thinks it has a heavier fluid in the hole but only has water in the annulus. This way formation damage is eliminated and higher pressures are exerted in the wellbore creating a reduced collapse window and reduced wellbore collapse issue.

BRIEF SUMMARY OF THE INVENTION

The present invention solves the problems faced in the art in a simple and straightforward manner. The present invention provides a method of drilling multiple boreholes within a single caisson, to recover methane gas from coal seams, including the steps of drilling first and second vertical boreholes from a single location within a single caisson; drilling at least one or more horizontal wells from the several vertical bore hole, the horizontal wells drilled substantially parallel or at a 45 degree angle to a face cleat in the coal bed; drilling at least one or more lateral wells from the one or more horizontal wells, the lateral wells drilled substantially perpendicular to one or more face cleats in the coal seam or seams; continuously circulating water through the drilled vertical, horizontal and lateral wells to recover the water and cuttings from the coal seam; applying friction or choke manifold to the water circulating down the well bores so that the water creates an Equivalent Circulating Density (ECD) pressure within the well bore sufficient to maintain an equilibrium with the hydrostatic pressure in the coal bed formation; and drilling at least a third vertical borehole within the single caisson, with one or more horizontal boreholes and one or more lateral boreholes for returning water obtained from the lateral producing wells into a water zone beneath the surface for water injection during the production phase.

In the system of the present invention, the present invention would enable the prevention of pressured CBM (over-pressured coal) reservoir damage. This may be done through the use of concentric casing string for annular friction control and in combination with surface choking systems control of bottom hole pressures, which allows the reservoir to be drilled and completed in a non-invasive and stable bore hole environment. Manage Pressure Drilling (MPD) may be accomplished by many means including combinations of backpressure, variable fluid density, fluid rheology, circulating friction and hole geometry. MPD can overcome a variety of problems, including shallow geotechnical hazards, well bore instability, lost circulation, and narrow margins between formation pore pressure and fracture gradient.

In an embodiment of the method of the present invention, the method comprises drilling multiple boreholes within a single caisson, to recover methane gas from a coal bed, comprising the following steps: (a) drilling a first vertical borehole from a single location within a single caisson; (b) drilling at least one horizontal well from the vertical bore hole, the horizontal well drilled substantially parallel to a face cleat in the coal bed; (c) drilling at least one or more lateral wells from the horizontal well, the lateral wells drilled substantially perpendicular to one or more face cleats in the coal bed; (d) continuously circulating water through the drilled wells to circulate water and cuttings from the coal bed; and (e) applying friction and or choke methods or a combination of both to the water circulating so that the water attains a hydrostatic pressure within the well sufficient to maintain an equilibrium with the hydrostatic pressure in the coal bed formation to prevent collapse of the well.

In another embodiment of the method of the present invention, there is drilled at least a second vertical borehole within the single caisson, with one or more horizontal boreholes and one or more lateral boreholes for recovering methane gas and water from the second borehole using the continuous circulating process and maintaining the water under a certain hydrostatic pressure equal to the pressure within the coal bed.

In another embodiment of the method of the present invention, there is drilled at least a third vertical borehole within the single caisson, with one or more horizontal boreholes and one or more lateral boreholes for returning water received from the first and second wells into a waste water zone beneath the surface.

In another embodiment of the method of the present invention, the water recovered from the coal bed seam is separated removing solids, filtered and returned down the third borehole into the waste water zone, while the methane gas is stored above the surface.

In another embodiment of the method of the present invention, imparting a friction component to the flow of the water as it is circulated within the drilled wells provides a greater hydrostatic pressure to the water equal to the hydrostatic pressure obtained by using chemicals in the water that may be harmful to the coal bed and impede recovery of the methane gas.

In another embodiment of the method of the present invention, circulating fresh untreated water with greater hydrostatic pressure obtained by friction or a choke manifold down the drilled wells to recover the methane gas eliminates the use of chemicals in the water which would reduce or stop the flow of methane gas from the coal bed formation.

In another embodiment of the method of the present invention, the recovery of the methane gas from the coal formation would be done through lateral wells being drilled perpendicular to face cleats in the coal bed formation for maximum recovery of methane gas.

Another embodiment of the method of the present invention comprises a method of drilling multiple boreholes within a single caisson, to recovery methane gas from a coal bed, comprising the following steps: (a) drilling first and second vertical boreholes from a single location within a single caisson; (b) drilling at least one or more horizontal wells from the several vertical bore holes, the horizontal wells drilled substantially parallel to a face cleat in the coal bed; (c) drilling at least one or more lateral wells from the one or more horizontal wells, the lateral wells drilled substantially perpendicular to one or more face cleats in the coal bed; (d) continuously circulating water through the drilled vertical, horizontal and lateral wells to recover the water and entrained methane gas from the coal bed; e) applying friction or choke manifold to the water circulating down the well bores so that the water attains a hydrostatic pressure within the well sufficient to maintain an equilibrium with the hydrostatic pressure in the coal bed formation; and (f) drilling at least a third vertical borehole within the single caisson, with one or more horizontal boreholes and one or more lateral boreholes for returning the water circulated from the lateral wells into a waste water zone beneath the surface.

In another embodiment of the method of the present invention, the recovery of the methane gas from the coal formation would be done through lateral wells being drilled perpendicular to face cleat fractures in the coal bed formation for maximum recovery of methane gas.

In another embodiment of the method of the present invention, one or more horizontal wells are drilled from the vertical well, each horizontal well drilled parallel to the face cleat fractures in the coal bed and one or more lateral wells are drilled from the horizontal wells, each lateral well drilled perpendicular to the face cleat fractures to provide a maximum recovery of methane gas as the laterals wells penetrate a plurality of face cleat fractures.

Another embodiment of the method of the present invention comprises a method of drilling multiple boreholes within a single caisson, to recovery methane gas from a coal bed, comprising the following steps: (a) drilling first and second vertical boreholes from a single location within a single caisson; (b) drilling at least one or more horizontal wells from the several vertical bore holes, the horizontal wells drilled substantially parallel to a face cleat in the coal bed; (c) drilling at least one or more lateral wells from the one or more horizontal wells, the lateral wells drilled substantially perpendicular to one or more face cleats in the coal bed; (d) continuously circulating water through the drilled vertical, horizontal and lateral wells to recover the water and entrained methane gas from the coal bed; (e) applying friction or choke manifold to the water circulating down the well bores so that the water appears to have a hydrostatic pressure within the well sufficient to maintain an equilibrium with the hydrostatic pressure in the coal bed formation; and (f) drilling at least a third vertical borehole within the single caisson, with one or more horizontal boreholes and one or more lateral boreholes for returning water obtained from the lateral wells into a waste water zone beneath the surface.

In another embodiment of the method of the present invention, imparting friction or choke to the circulating water, increases the hydrostatic effects of the water from a weight of 8.6 lbs/gal to at least 12.5 lbs/gal, substantially equal to the hydrostatic pressure of the coal formation.

Another embodiment of the present invention comprises a method of recovering methane gas from a pressurized coal bed through one or more wells within a single caisson by continuously circulating untreated water having an effective hydrostatic pressure equal to the coal bed formation, so that methane gas entrained in the formation can flow into the circulating water and be recovered from the circulating water when the water is returned to the surface, and the water can be recirculated into a waste water zone beneath the surface through a separate well within the caisson.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

FIGS. 1 through 11 illustrate the preferred method of the present invention, which in summary is a plurality of wells being drilled through a single caisson from the rig floor, at least two of the wells drilled for the ultimate collection of methane gas from a coal seam, and a third well drilled to return waste water used in the process to a water collection zone beneath the surface.

Figure 1:
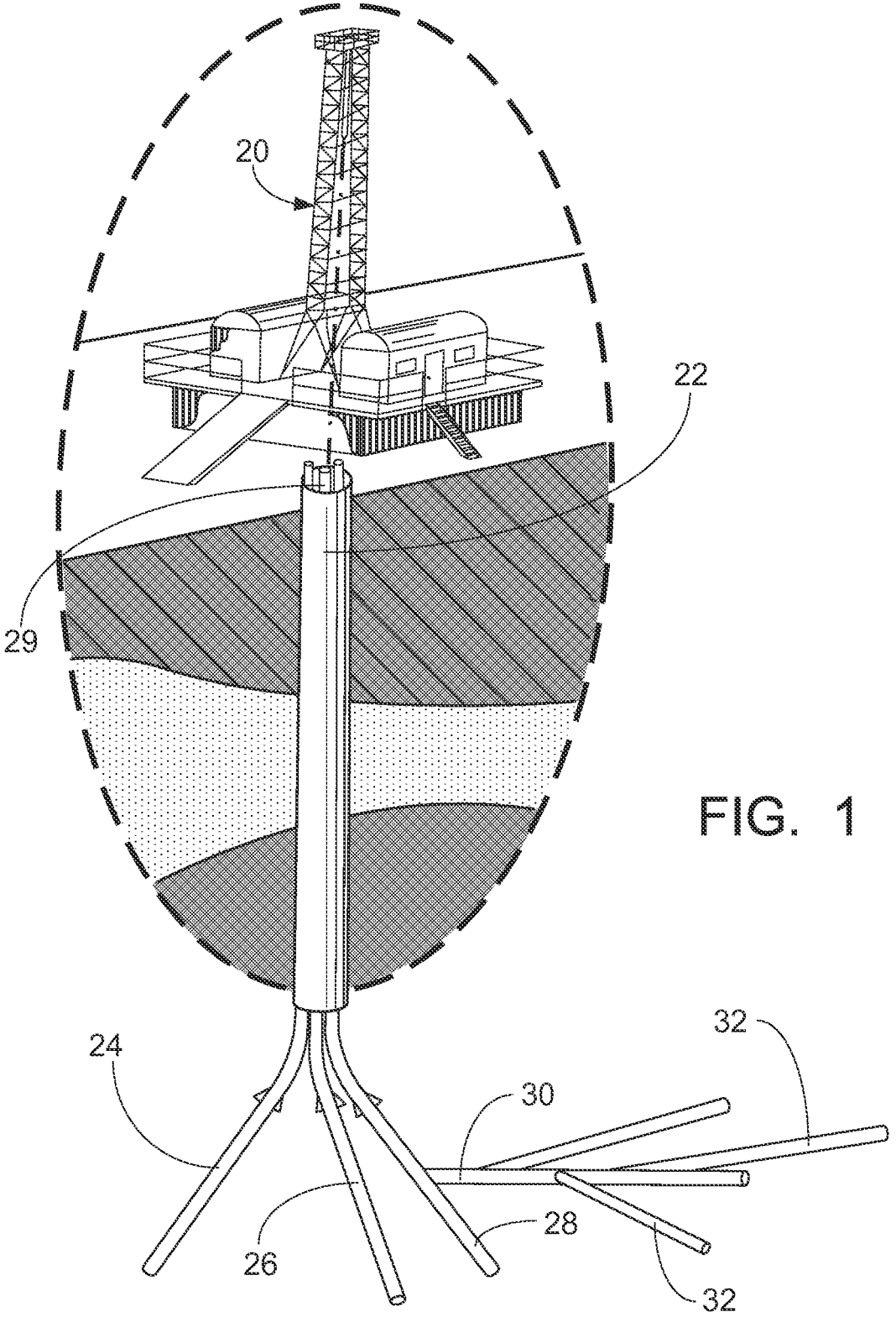
FIG. 1 illustrates an overall view of multiple wells being drilled out of a single caisson from a single location in the method of the present invention.
Figure 2:
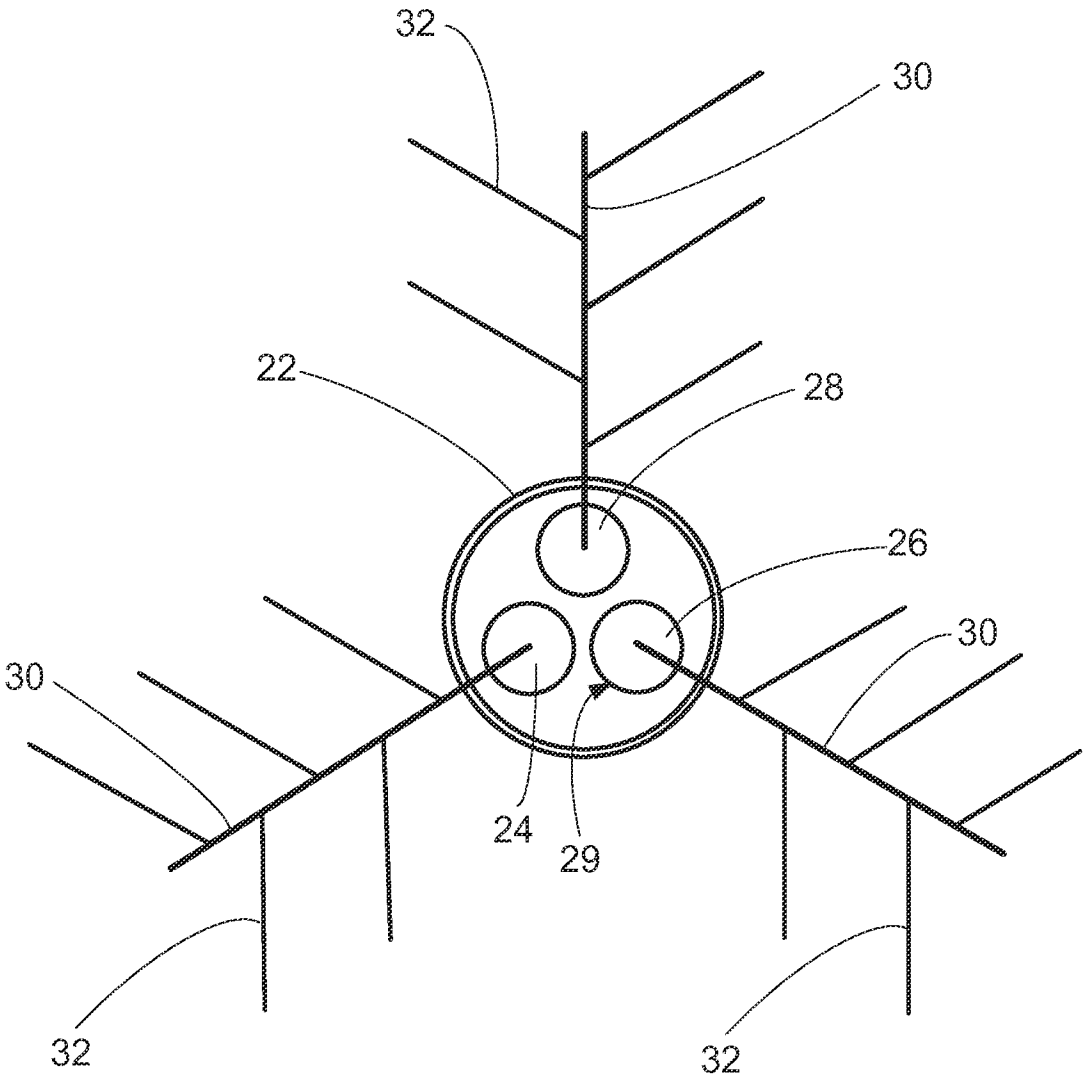
FIG. 2 illustrates a cross-section view of the multiple wells within the caisson as illustrated in FIG. 1 in the method of the present invention.

Turning now to the individual Figures, as seen in overall view in FIG. 1, and in cross-section view in FIG. 2, there is illustrated in overall view in FIG. 1, a drilling rig 20 having a single caisson 22 with three wells 24, 26, 28 within the single caisson 22. As seen, each of the wells include a vertical well section 29, which terminates in at least one or more horizontal wells 30, which branch off into a plurality of lateral wells 32, for reasons stated herein. Of the three wells depicted, two of the wells 24, 26 are multilateral wells to produce water and methane gas, while the third well 28 comprises an injection well 28 that can inject waste water back into one of the underground reservoirs.

Figure 7:
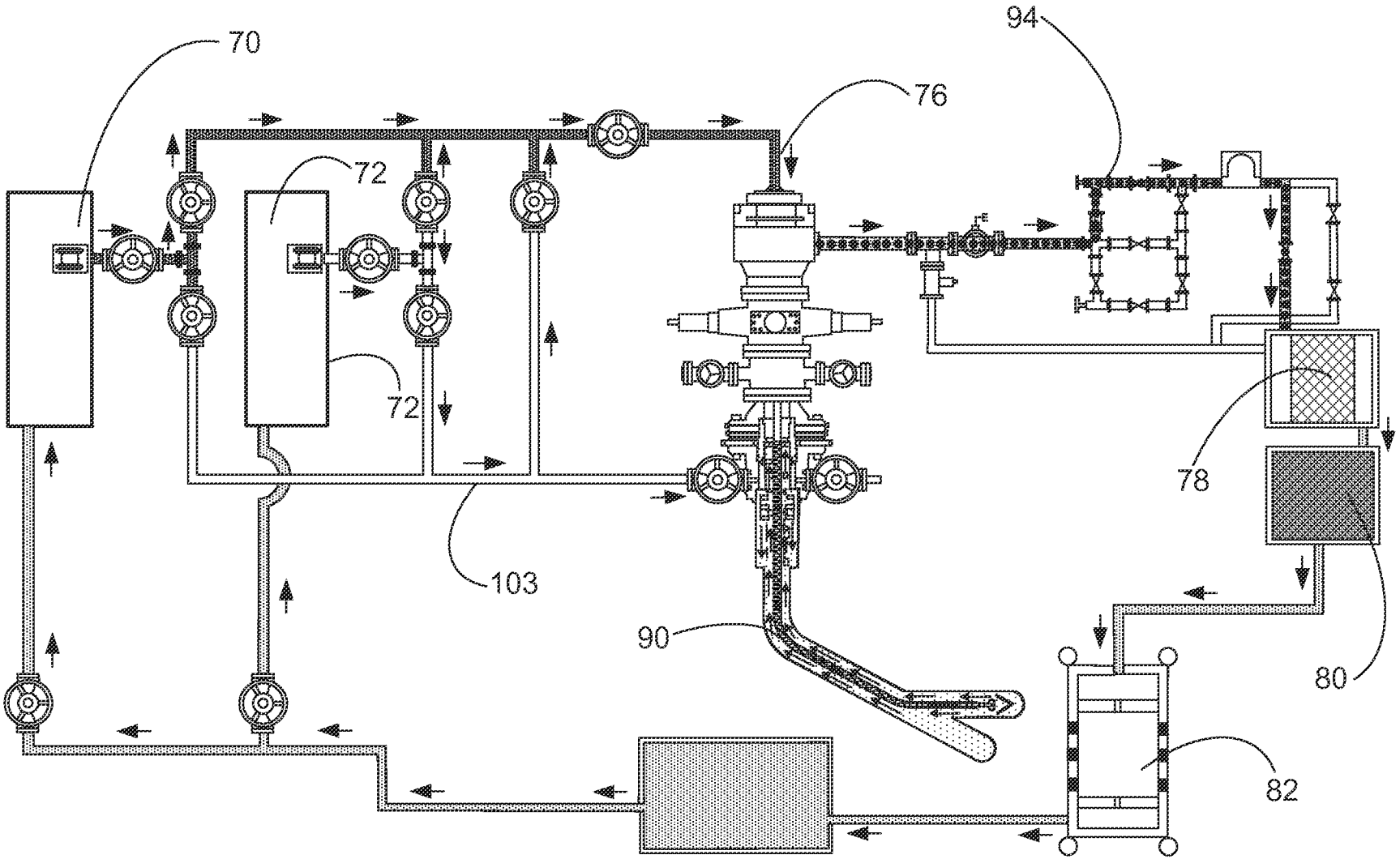
FIG. 7 illustrates the continuous circulating concentric casing pressure management with friction and choke methods in the method of the present invention.

The two producing wells 24, 26 would produce the water and methane gas after completion, where the recovery from these wells would be run thru a centrifuge 82 (as seen in FIG. 7) to remove the fine particles during the drilling phase and additionally a centrifuge would be used after completion to remove the coal fines for re-injection, while for the third well 28, water would be re-injected back into the earth in a water bearing zone. The configuration of the three wells 24, 26, 28 within a single conduit or caisson 22 is important and novel since this allows the single site to produce gas through the circulated water in wells 24, and 26, and send waste water down into the water bearing zone via well 28, rather than on site collection ponds, which may be required in some jurisdictional legal guidelines.

Figure 3B:
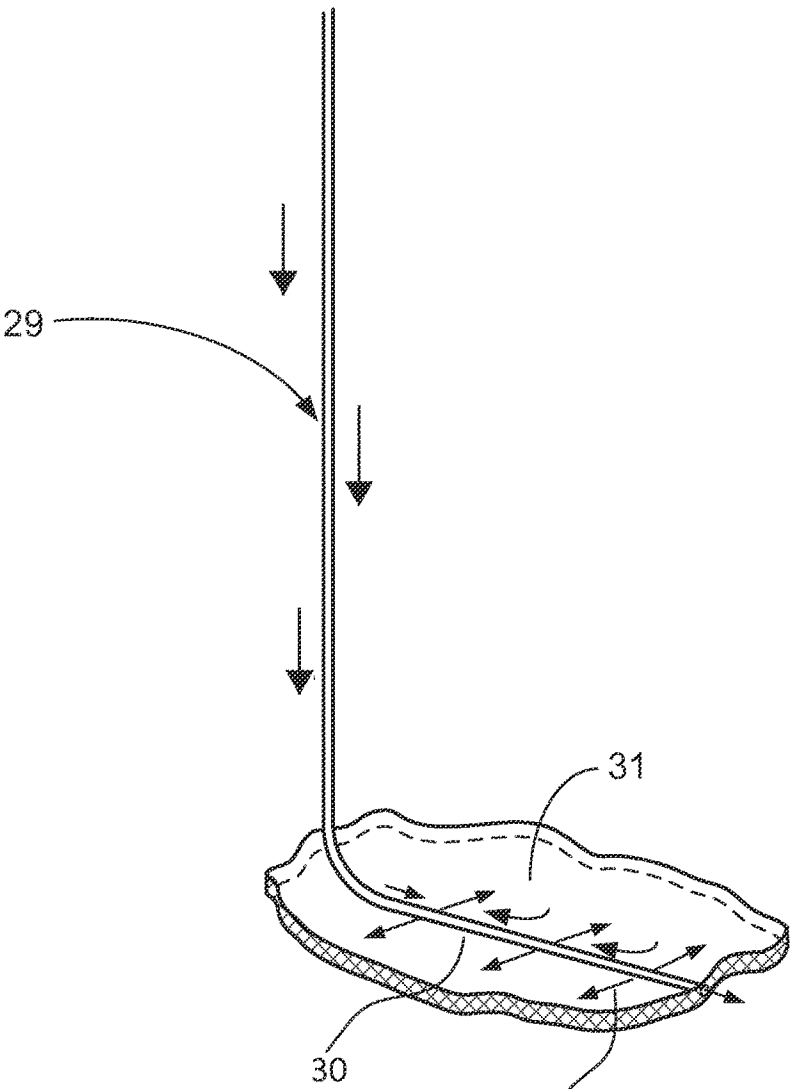
FIG. 3B illustrates a water injection well returning waste water into the formation through a use of a horizontal well extending from the vertical well in FIG. 3A in the method of the present invention.
Figure 3A:
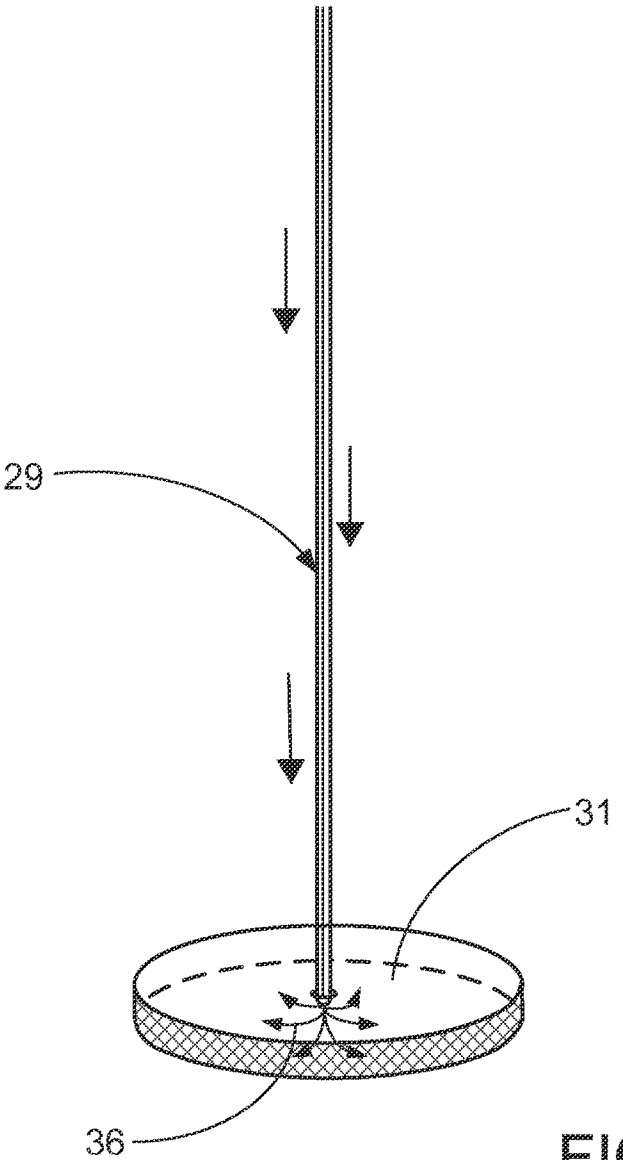
FIG. 3A illustrates a water injection well to return waste water into the formation utilizing a vertical well in the method of the present invention.
Figure 4:
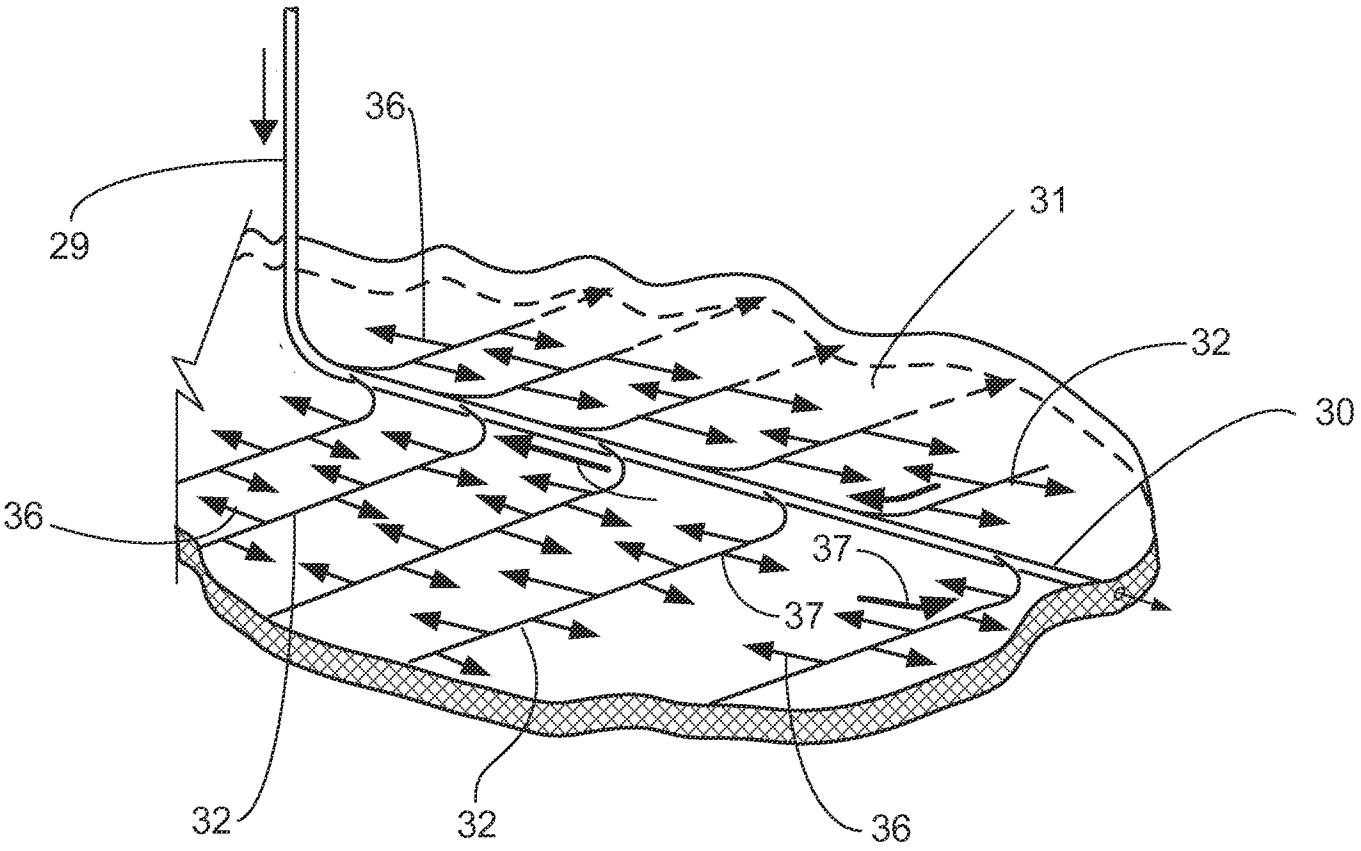
FIG. 4 illustrates yet another embodiment of the water injection well in FIGS. 3A and 3B, where there are multiple lateral wells extending out from the horizontal well in the method of the present invention.

As further illustrated in FIGS. 3A and 3B, water 36 is being injected into a vertical well section 29 (FIG. 3A), or into a horizontal well 30 (FIG. 3B) or into a horizontal with multiple laterals 32, as seen in FIG. 4 for sending the water into water bearing zones in formation 31. FIG. 4 depicts injection down the hole of produced water or produced waste water 37 that has been run thru solids removal equipment.

In understanding the nature of a coal seam, coal seams contain face cleats and butt cleats. All of the face cleats comprise cracks in the coal seam which are in a certain direction and comprise the pathway for gas movement thru the coal seam, while the butt cleats connect the face cleats. In a coal seam all major fractures, or face cleats, are in the same direction. Therefore, if one drills in parallel to the face cleats, and only connects two of them, this is the most stable direction. But, if one drills perpendicular to the face cleats, and connects all of the fractures, the recovery is very good, which has, in effect, created a new mechanical induced butt cleat, i.e., connecting one or more face cleats. Drilling from parallel to perpendicular requires more hydrostatic pressure, i.e. mud weight, going from stable to unstable. Most drillers want to drill parallel to the face cleats to avoid the instability in the well. For example, the mine shaft in a coal mine may be mined parallel to the face cleats, to avoid collapse of the mine shaft. However, in coal bed drilling for methane gas, the recovery, when one drills perpendicular to the face cleats is 10 to 20 times more productive; therefore, the most productive direction is to drill perpendicular.

Figure 5:
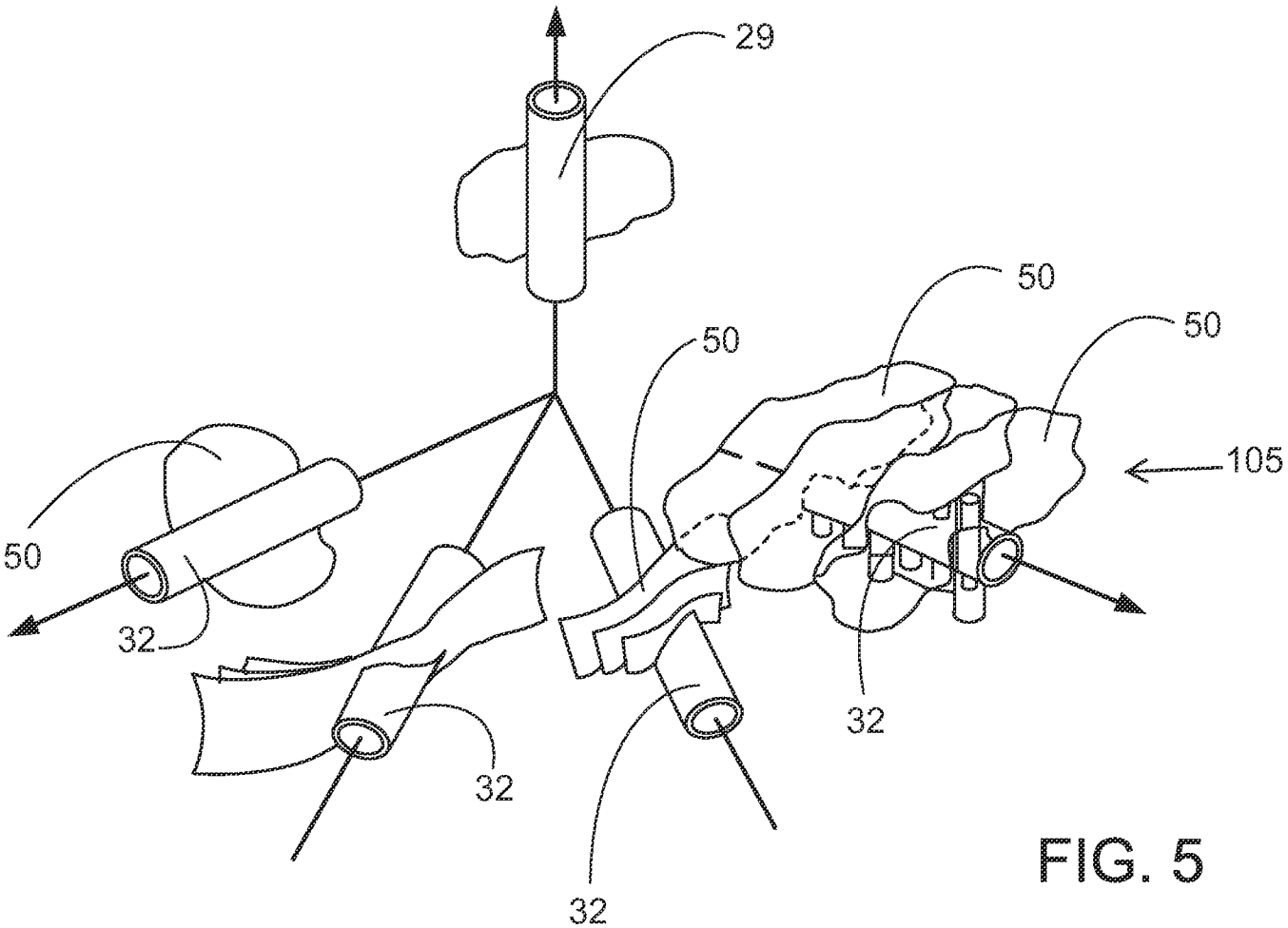
FIG. 5 illustrates a depiction of the drilling of the lateral wells perpendicular to the face cleats in the coal seam to recover maximum of methane gas from the coal seam in the method of the present invention.

With that in mind, turning now to FIG. 5, it has been determined that if there is a fracture in the coal seam, referenced as face cleat fractures 50, that these face cleat fractures 50 would all be parallel one another in the coal seam. One would drill a vertical well, such as well 24, and drill the horizontal well 30 parallel to the fractures 50 for attaining the most stable well bore, which means the less likely to collapse under downhole pressures. Drilling parallel to the fractures 50 is the most stable direction, but it is the least productive of the drilling. One would want to be able to drill perpendicular to the fractures 50 for maximum production of methane gas through the lateral wells 32. As stated earlier, drilling perpendicular to the fractures is useful because production of methane gas is ten to twenty times greater when the production wells are perpendicular to the fractures 50 rather than parallel to the fractures 50.

In an embodiment of the present invention, to drill perpendicular to the face cleat fractures 50 in a stable environment, one would provide higher hydrostatic pressure by higher mud weight or, with water alone, having the water exhibit characteristics which renders its weight or ECD from 8.6 to 12.6 lbs/gal, for example. An embodiment of the present invention provides the desired weight or ECD thru creating mechanical friction, since fluid has resistance, which creates back pressure. In another embodiment, using fresh water, the method comprises use of chokes on surface. For example, one would pump in 100 gallons, but only let out 90 gallons, therefore creating back pressure. The back pressure caused by this process would give greater weight effect or ECD to the water, and increase sufficient hydrostatic pressure in the well bore.

In an embodiment of the present invention, one would use treated water free from any chemicals and bacteria. An object of the present invention is to enable a cleaner formation with no damage by chemicals. However, because the perpendicular drilled wells create instability, in order to minimize that problem, a higher bottom hole pressure is useful, when the coal seam is pressurized down hole. As discussed earlier, in order to minimize a coal seam from being damaged by mud additives added to water in order to create a greater hydrostatic pressure, in a preferred embodiment one would drill with clear water. However, it is difficult to obtain the proper hydrostatic pressure to keep the well from collapsing with just water, without increasing the hydrostatic pressure in some manner. In coal reservoirs which are pressured, there is a need for a process to obtain instantaneous increases of hydrostatic pressure from 8.6 to 12.6 lbs per gallon mud or higher, such as barite or other chemicals added to the water. These chemicals damage the permeability in the formation, actually holding back the pressure, and reduce the opportunity for desorption of methane gas from the formation. Therefore, in a preferred embodiment pure or clear water (containing less than 4 microns of solids drilling fluid, for example) is used, which has a weight of 8.6, but has the effect as the heavier mud, at possibly 12 lbs/gal. In a preferred embodiment of the present invention, to address this problem, one would drill the wells from the parallel or sub-parallel to the perpendicular, without agents, such as chemicals, and with use of friction or back pressure, or a combination of both, as discussed earlier. These means, i.e. the friction or back pressure, can increase the circulating density of the fluid, which is only water in a preferred embodiment.

Figure 6:
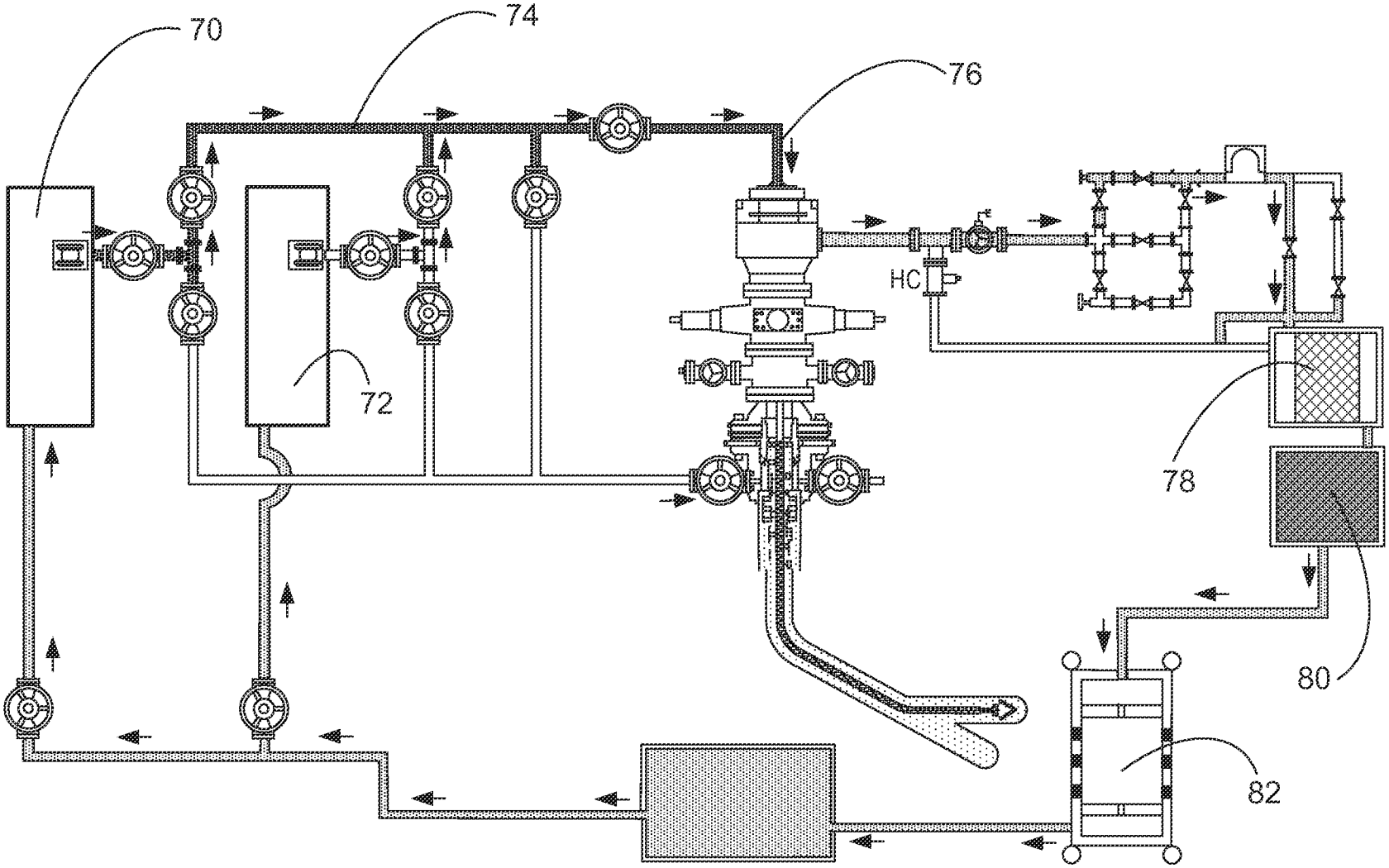
FIG. 6 illustrates the single pass continuous circulation drilling utilized in the method of the present invention.
Figure 8:
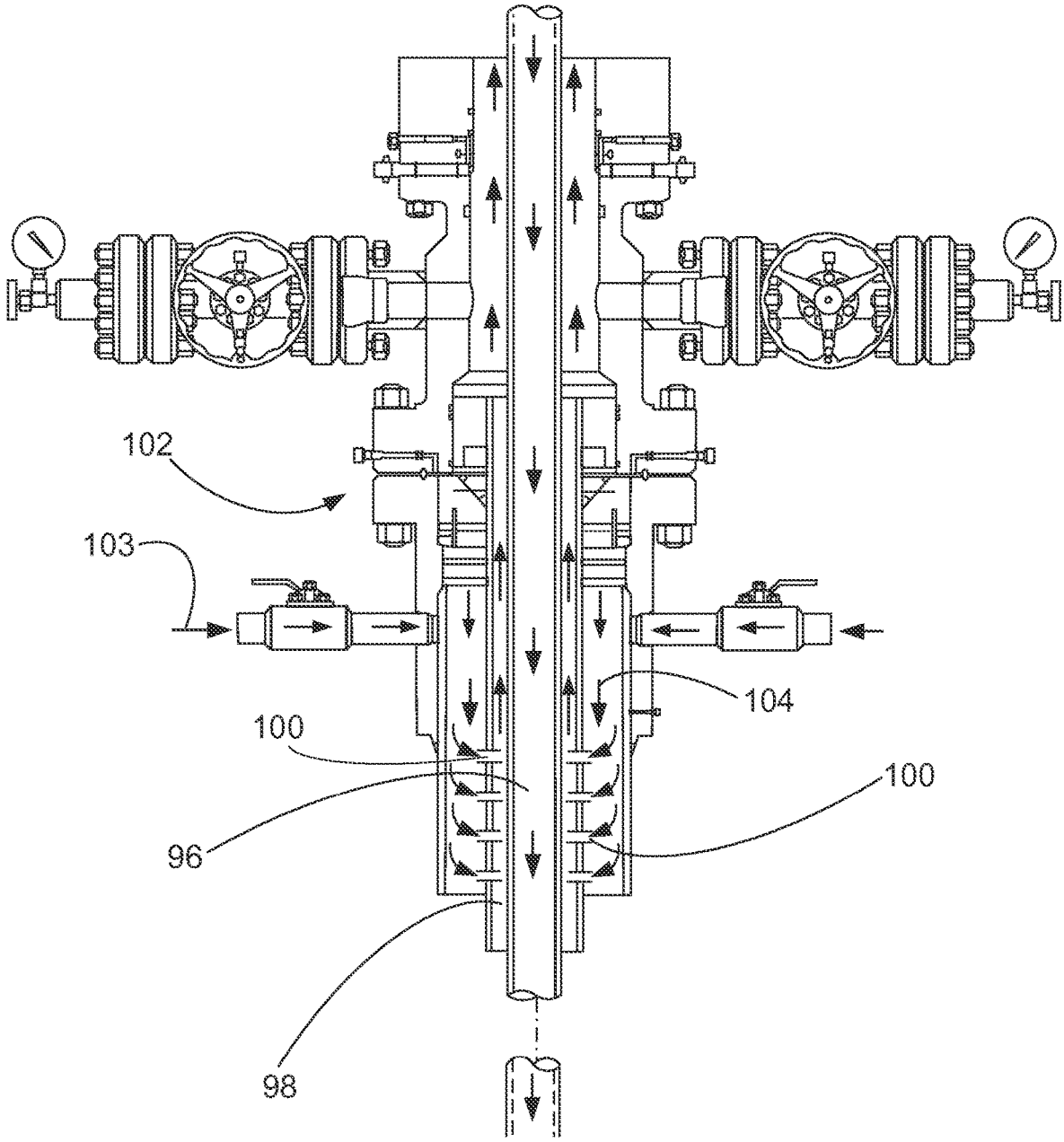
FIG. 8 illustrates a wellhead for continuous circulation in the method of the present invention.

Turning therefore to FIGS. 6 through 8, these figures show that on the surface systems may be used to increase friction within the well or through the use of a choke manifold, or a combination of both circulated continuously down the concentric annulus, both of which would cause the water to exhibit a greater hydrostatic pressure, of a suitable magnitude, without the use of chemical or surfactants. By creating the higher equivalent of back pressure, through friction or a choke manifold, one is able to drill the wells perpendicular, for greater recovery of methane gas. That allows one to drill perpendicular and have a higher effective bottom hole pressure without having the bore collapse. There are no chemical agents, such as surfactants involved, which can cause the clay to swell and choke off the flow of gas out of the formation.

It should be noted that as seen in FIGS. 6 through 8, the system, in a preferred embodiment, would be a continuous circulating system for reducing the likelihood of the formation collapsing under pressure, wherein the water through either friction or the choke valve maintains a 10 lb. per sq. inch pressure down hole, for example, without the use of chemicals.

In FIG. 6, water is pumped from pumps 70 and 72 via line 74 to the stand pipe 76 and circulated down the borehole. While circulating, due to the hydrostatic pressure of the water and choking effects, for reasons described earlier, the formation remains stable. The water is then returned from the borehole, and after cleansing through the shale shaker 78, de-silter 80, and decanting centrifuge 82, the water returns to pumps 70 and 72.

In FIGS. 7-8, the water is being pumped from pump 70 via line 74 to stand pipe 76 returning up bore 90. Simultaneously pumping with pump 70 from pump 72 via line 103, then down annulus 104 thru perforations 100, and returns commingled with fluid from pump 70 up the inner annulus 98 of the well, and goes to the rig choke manifold 94. This creates both friction control of the annulus and choking to increase the hydrostatic ECD control of bottom hole pressure. The water is then cleansed and returns to pumps 70 and 72. FIG. 8 illustrates a view of a well head 102, with the water being pumped down an inner bore 96, and returned up an annulus 98 where the water from pump 70 and pump 72 are commingled creating the friction effect for hydrostatic friction which then returns to the rig floor for additional choking effect and separation. In a preferred embodiment the present invention is a continuous circulation system, if circulation stops, i.e., turn the pumps off, this can create a loss of friction and choking, so that the formation may collapse. Pump 72 during connections can increase its flow to match the gallons per minute of both pumps 70 and 72 to maintain the friction effect. After a connection is made and flow is re-established to pump 70, pump 72 can slow to the commingled volume and maintain the friction effect.

Figure 9:
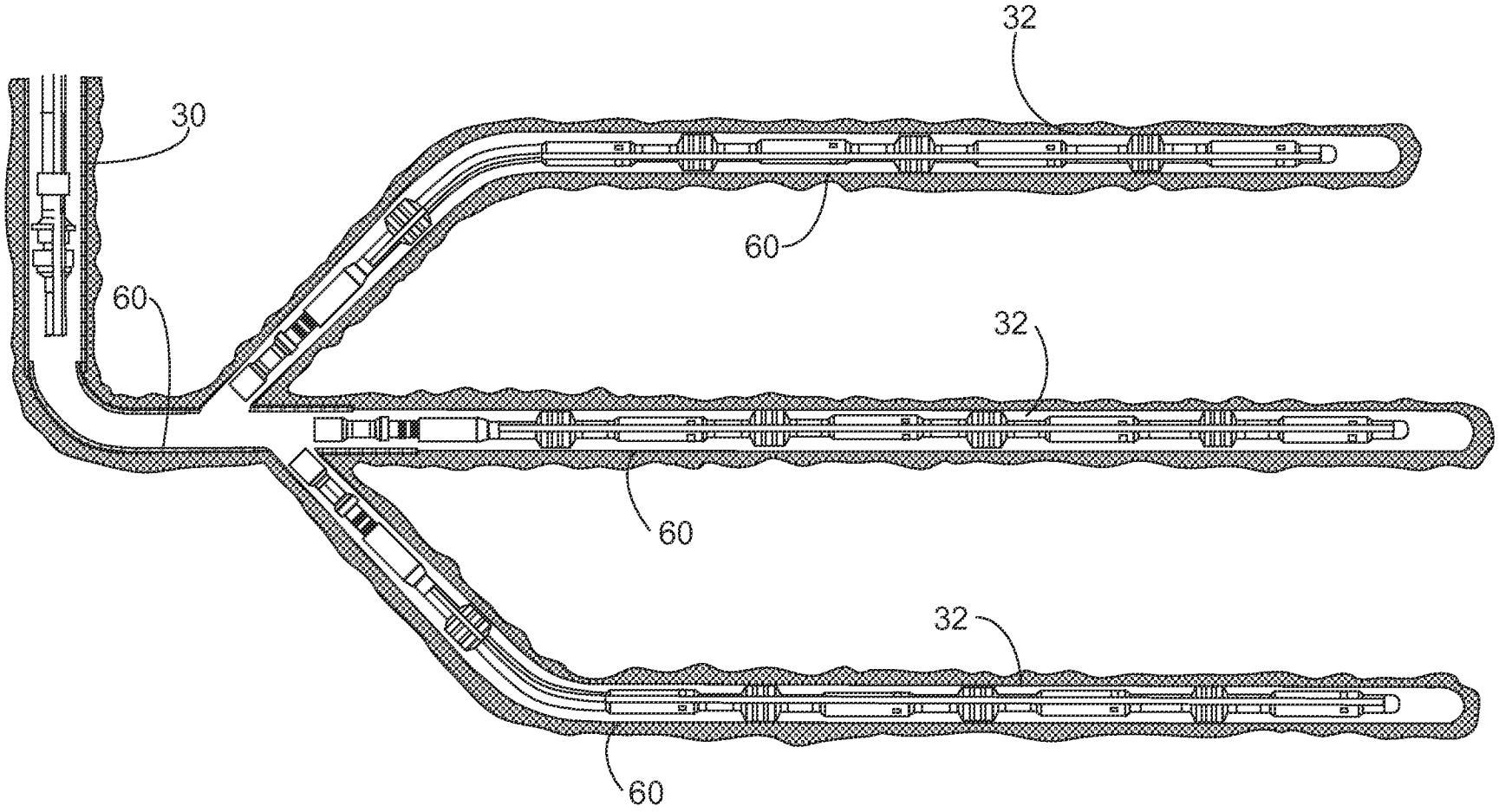
FIG. 9 illustrates a plurality of lateral wells which have been lined with liners as the methane gas is collected from the coal seam in the method of the present invention.
Figure 10:
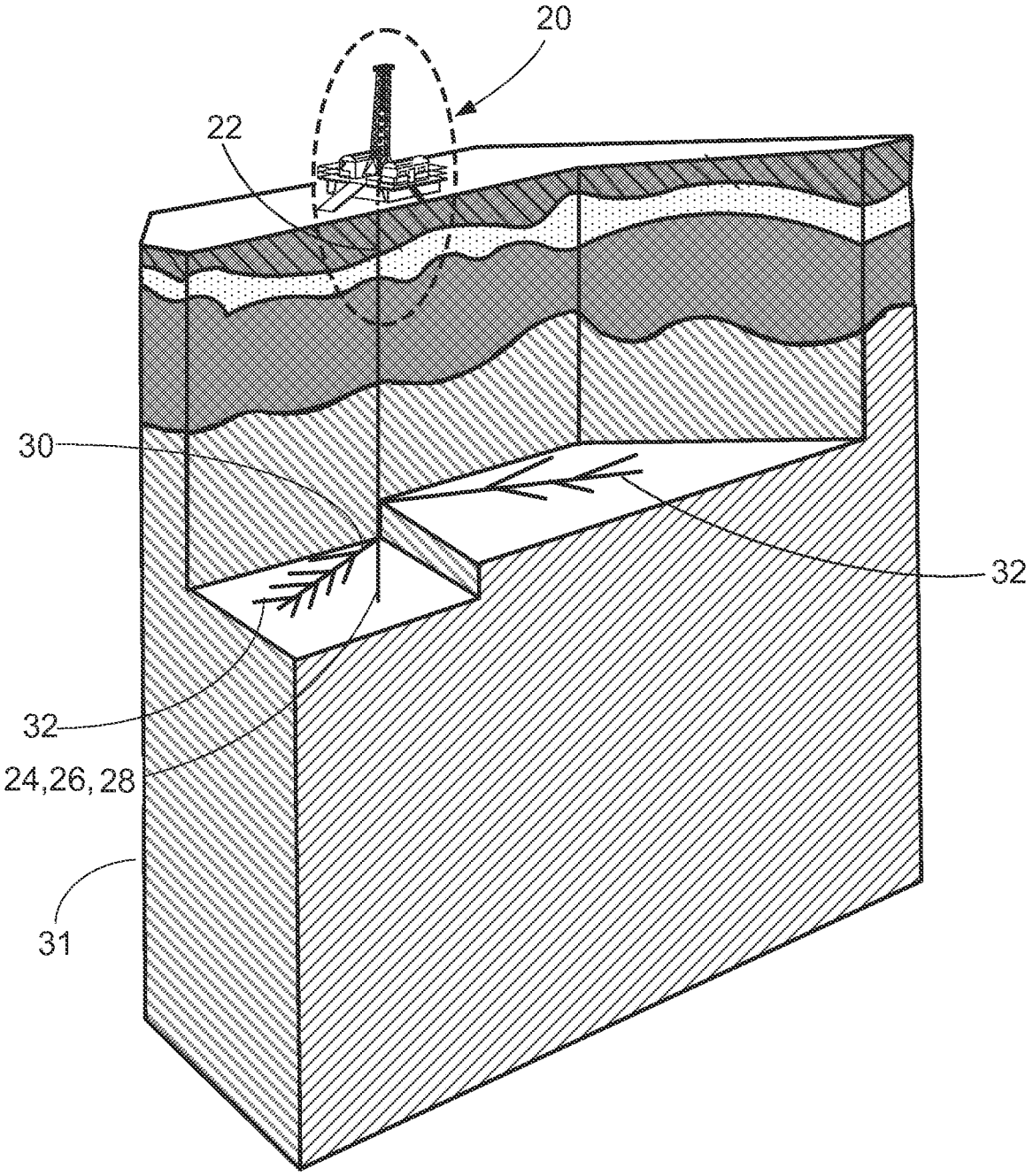
FIG. 10 illustrates an overall view of the methane gas collection from the coal seam utilizing a plurality of lateral wells and the water injection well returning used water into the underground, all through the same caisson in the method of the present invention.

As illustrated in FIG. 9, at some point in time during the process, one may wish to case the laterals 32 off. FIG. 9 illustrates slotted liners 60 which have been inserted into each of the laterals 32. This is useful to help maintain the integrity of the laterals 32 during the method of the invention.

Figure 11:
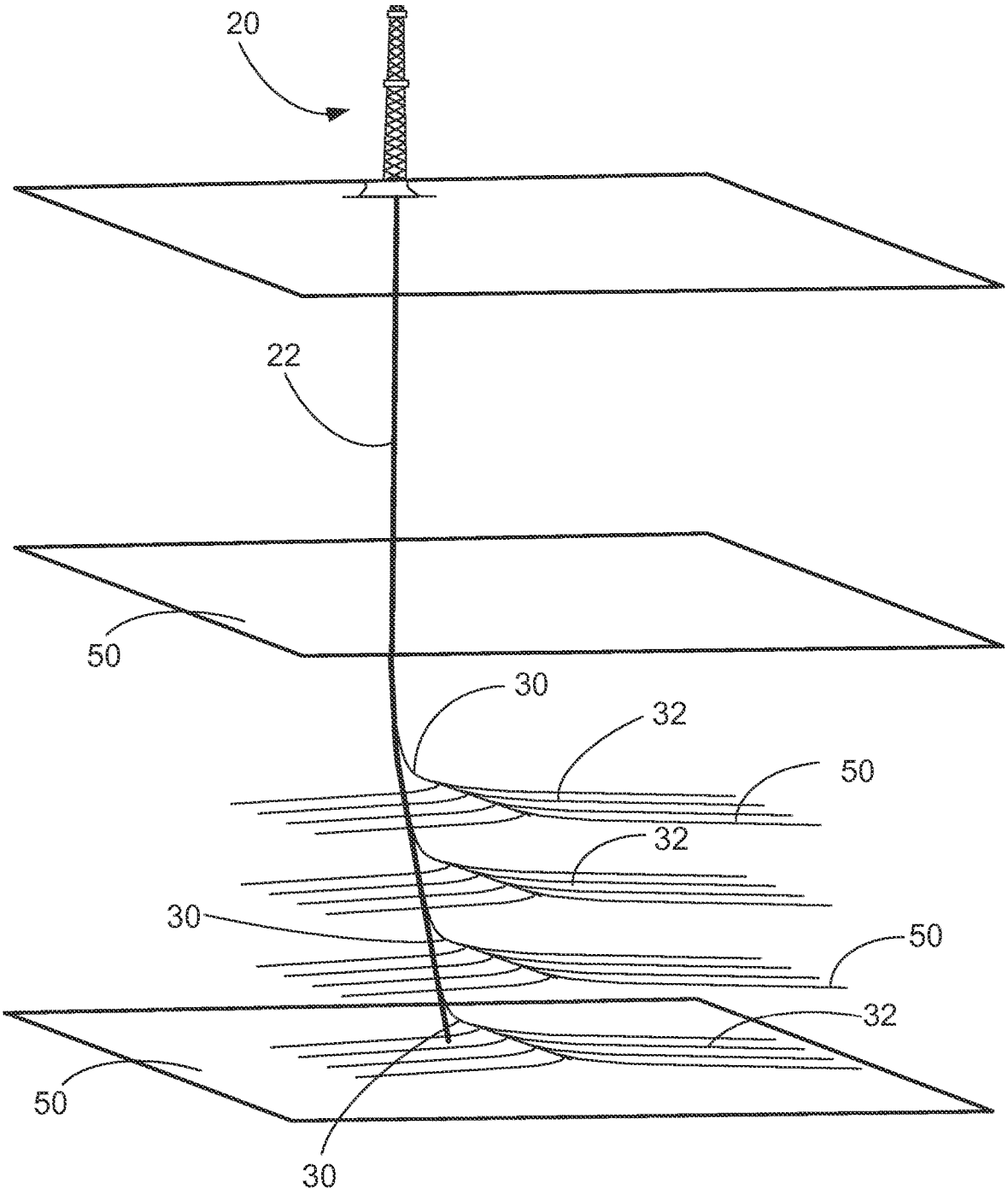
FIG. 11 illustrates a depiction of a plurality of horizontal wells having been drilled parallel to the face cleats and a plurality lateral wells having been drilled perpendicular to the face cleats in the coal seam for obtaining maximum collection of methane gas.

In FIG. 10, there is again depicted an overall view of a drilling rig 20 with multiple wells from a single caisson 22, where some of the laterals 32 from wells 24, 26 are collecting methane gas by continuously circulating water into the formation, while laterals 32 from a third well 28 are returning waste water to the water bearing zones beneath the surface. In FIG. 11, there is depicted the vertical wells extending from the single caisson 22, where there are a plurality of horizontal wells 30 drilled in the same direction as the face cleat fractures 50, to maintain stability, but where there are a plurality of lateral wells 32 being drilled perpendicular to the horizontal wells 30 through multiple face cleats 50 of the coal seam, to obtain maximum methane gas recovery. In an embodiment of the present invention, cased hole or open hole may be used, wherein the hydrostatic pressure is maintained through the continuous circulation of the water through the system under friction or through a choke at the surface, for maintaining the hydrostatic pressure of the water sufficiently high to prevent collapse of the formation at all times.

In an embodiment of the present invention, the novel system for recovering methane gas from coal seams involves a continuously circulating concentric pressure drilling program which may be adapted to include a splitter wellhead system for purposes of using a single borehole with three wells, or conduits, in the single borehole, with two of the conduits used for completing coal bed methane wells, and the third used as a water disposal well all within a single well caisson.

An embodiment of the present invention, involves a process for recovering methane from coal seams through the following steps: drilling and installing a caisson with multiple conduits; drilling a well bore through the conduit into a coal seam; using a continuous circulating process to drill and complete those wells within the coal seam with the lateral wells being perpendicular to the face cleats of the coal seam so that the well extends through multiple face cleats for maximum recovery of methane gas; completing each well either open or cased hole; next, drill the second well, and complete a series of multi-lateral wells into the coal seam perpendicular to the face cleat fractures as described earlier; then, in the third conduit, drill a vertical or horizontal or multilateral well for disposing the water produced from the other two conduits. The water would be returned through a pumping mechanism from conduits 1 and 2, filtered for solids removal, and re-injected into the well bore via the borehole in conduit 3. The present invention overcomes problems in the prior art thru use of multiple wells drilled from a single caisson in a coal bed methane system, using friction and choking methods to maintain the proper hydrostatic pressure of pure water, for coal bed methane recovery in at least two of the wells, and injecting water down hole, all within the same vertical well bore.

In an embodiment of the method of the present invention for a continuous circulating concentric casing managed equivalent circulating density (ECD) drilling method, the method involves a continuous circulating concentric casing using less than conventional mud density. Using less than conventional mud density, the well will be stable and dynamically dead, but may be statically underbalanced (see FIG. 12). As stated earlier, in an embodiment of the invention and in the well planning, one would drill wells perpendicular to the face cleats of the coal. From the face cleat direction, there would be a single fracture, reorientation and a single t-shaped multiple 105 provided as seen in FIG. 5.

For purposes of the below paragraph, the following abbreviations will apply:

Equivalent Circulating Density (ECD)
Managed Pressure Drilling (MPD)
Bottom Hole Pressure (BHP)
Bottom Hole Circulating Pressure (BHCP)
Mud Weight (MW)

The MPD advantage as seen is at under conventional drilling MPD=MW+Annulus Friction Pressure. BHP control=only pump speed and MW change, because it is an "Open to Atmosphere" system; whereas in Managed Pressure Drilling (MPD), the MPD=MW+Annulus Friction Pressure+Backpressure. BHP control=pump speed, MW change and application of back pressure, because it is an enclosed, pressured system.

In the continuous circulating concentric casing pressure management, there is provided an adaptive drilling process used to precisely control the annular pressure profile throughout the wellbore. The objectives are to ascertain the downhole pressure environment limits and to manage the annular hydraulic pressure profile accordingly. It is an objective of the system to manage BHP from a specific gravity of 1 to 1.8 utilizing clean, less than 4 microns of solids, for example, in the drilling fluid. The drilling fluid may be comprised of produced water from other field wells. Any influx incidental to the operation would be safely contained using an appropriate process.

Figure 12:
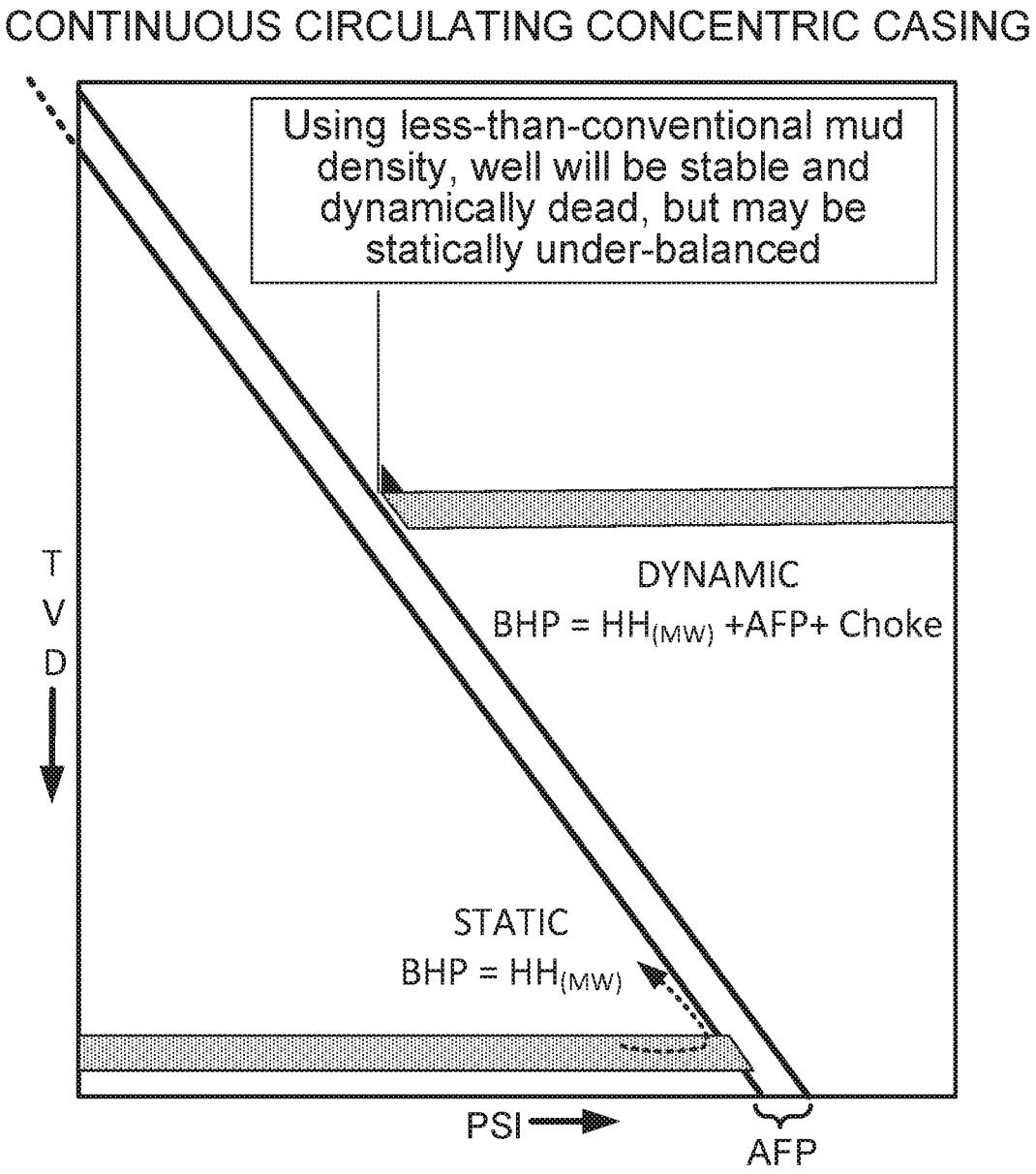
FIG. 12 illustrates a continuous circulating concentric casing in the method of the present invention.

FIG. 12 illustrates a continuous circulating concentric casing where using less than conventional mud density, the well will be stable and dynamically dead, but may be statically underbalanced.

The following is a list of parts and materials suitable for use in the present invention:

PARTS LIST

| PART NUMBER | DESCRIPTION |
|---|---|
| 20 | drilling rig |
| 22 | caisson |
| 24, 26, 28 | wells |
| 29 | vertical well section |
| 30 | horizontal wells |
| 31 | formation |
| 32 | lateral wells |
| 36 | water |
| 37 | produced waste water |
| 50 | face cleat fractures |
| 60 | slotted liners |
| 70, 72 | pumps |
| 74 | line |
| 76 | stand pipe |

-continued

| PART NUMBER | DESCRIPTION |
|---|---|
| 78 | shale shaker |
| 80 | de-silter |
| 82 | centrifuge |
| 90 | bore |
| 94 | rig choke manifold |
| 96 | inner bore |
| 98 | annulus |
| 100 | perforations |
| 102 | well head |
| 103 | line from pump 72 |
| 104 | inner annulus |
| 105 | t-shaped multiple |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of drilling one or more wells in a coal bed formation within a caisson during a drilling phase, wherein said one or more wells are for recovering methane gas from the coal bed formation during a production phase, comprising the following steps:

(a) drilling a first production well within the caisson, the first production well having a first lateral well that is drilled at least substantially parallel to a face cleat in the coal bed formation, and a second lateral well drilled from the first lateral well that is at least substantially perpendicular to one or more face cleats in the coal bed;

(b) circulating drilling fluid during the drilling phase through the first production well, said drilling fluid being substantially clear water, and said drilling fluid having a hydrostatic pressure and a weight; and (c) increasing the hydrostatic pressure of the drilling fluid so as to effectively increase the weight of the drilling fluid to an effective weight that prevents collapse during the drilling phase.

2. The method in claim 1, further comprising drilling a second production well within the caisson during the drilling phase, said second production well having a third lateral well drilled at least substantially parallel to a face cleat and a fourth lateral well drilled at least substantially perpendicular to a face cleat, and wherein said first production well and said second production well are operable to recover methane gas from produced water in the first production well and the second production well during the production phase of the coal bed formation.

3. The method in claim 1, further comprising drilling at least one injection well within the caisson for returning produced water received from the first production well into a waste water zone beneath a surface of the coal bed formation.

4. The method in claim 3, wherein the produced water recovered from the coal bed formation during the production phase is separated removing solids and filtered before being returned down the injection well into the waste water zone, and wherein methane gas recovered from the produced water is stored above the surface.

5. The method in claim 1, wherein the hydrostatic pressure of the drilling fluid is increased using friction or choke methods, or a combination of both friction and choke methods, applied to the circulating drilling fluid.

6. The method in claim 5, wherein chemicals are not added to the drilling fluid to increase the weight of the drilling fluid.

7. The method in claim 1, wherein methane gas from the coal bed is recovered from the second lateral well drilled at least substantially perpendicular to the one or more face cleats in the coal bed, enabling maximum recovery of methane gas during production.

8. The method in claim 1, wherein applying friction or choke to the circulating drilling water, increases the drilling water hydrostatic pressure and weight effect of the circulating drilling water from a weight of 8.6 lbs/gal to 12.5 lbs/gal.

9. The method in claim 8, wherein the second lateral well is drilled perpendicular to a plurality of face cleats to penetrate the plurality of face cleats and to increase methane gas production during the production phase.

10. A method of drilling multiple boreholes in a coal bed formation within a caisson in a drilling phase, comprising the following steps:

(a) drilling a first borehole at a first location within the caisson;

(b) drilling a first lateral well from the first borehole, said first lateral well drilled at least substantially parallel to a face cleat in the coal bed formation;

(c) drilling a second lateral well from the first lateral well, the second lateral well drilled at least substantially perpendicular to one or more face cleats in the coal bed formation;

(d) continuously circulating drilling water that is at least substantially clear through the first borehole, and through the first lateral well and the second lateral well during the drilling phase, said drilling water having a hydrostatic pressure and a weight; and (e) applying friction to, or choking, the continuously circulating drilling water during the drilling phase to increase the hydrostatic pressure and a weight effect of the drilling water a sufficient amount to maintain an equilibrium with a coal bed formation hydrostatic pressure to prevent the coal bed formation from collapsing.

11. The method in claim 10, wherein during a production phase, further comprising recovering methane gas from the coal bed formation through produced water in the second lateral well that is drilled perpendicular to said one or more face cleats in the coal bed formation for maximum recovery of methane gas.

12. A method of recovering methane gas from a coal bed formation comprising the following steps:

(a) drilling a production well, wherein while drilling the production well, drilling fluid that is substantially clear water is continuously circulated through the production well and wherein a hydrostatic pressure of the drilling fluid is increased while circulating the drilling fluid;

(b) producing water with methane gas in the production well;

(c) recovering the methane gas from the water produced in step "b"; and wherein the production well comprises a first well drilled at least substantially parallel to a face cleat in the coal bed formation, and a second well drilled from the first well and drilled at least substantially perpendicular to one or more face cleats in the coal bed.

13. The method of claim 12 further comprising drilling an injection well in step "a".

14. The method of claim 13 further comprising returning the water after step "c" to the coal bed formation via the injection well.

* * * * *